US007292123B2

(12) United States Patent
Tong et al.

(10) Patent No.: US 7,292,123 B2
(45) Date of Patent: Nov. 6, 2007

(54) WAVEGUIDE E-PLANE RF BANDPASS FILTER WITH PSEUDO-ELLIPTIC RESPONSE

(75) Inventors: Dominique Lo Hine Tong, Rennes (FR); Philippe Chambelin, Chateaugiron (FR); Charline Guguen, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 147 days.

(21) Appl. No.: 10/540,407

(22) PCT Filed: Dec. 18, 2003

(86) PCT No.: PCT/EP03/51049

§ 371 (c)(1),
(2), (4) Date: Jun. 24, 2005

(87) PCT Pub. No.: WO2004/062024

PCT Pub. Date: Jul. 22, 2004

(65) Prior Publication Data

US 2006/0044082 A1 Mar. 2, 2006

(30) Foreign Application Priority Data

Jan. 6, 2003 (FR) ..... 03 00160

(51) Int. Cl.
*H01P 1/208* (2006.01)

(52) U.S. Cl. ..... 333/208; 333/212; 333/248

(58) Field of Classification Search ..... 333/208, 333/209, 210, 212, 248
See application file for complete search history.

(56) References Cited

U.S. PATENT DOCUMENTS 4,761,625 A * 8/1988 Sharma ..... 333/209
4,897,623 A 1/1990 Reindel
4,990,870 A * 2/1991 Reindel ..... 333/208

OTHER PUBLICATIONS

W. Schwab et al. "Compact Bandpass Filters With Improved Stop-Band Characteristics Using Planar Multilayer Structures", Institute of Electrical and Electronics Engineers, Int'l Microwave Symposium Digest, Alburquerque, Jun. 1, 1992, vol. 3, pp. 1207-1209.
R. Vahldieck: "Quasi-Planar Filters For Millimeter-Wave Applications" IEEE Transactions on Microwave Theory and Techniques, IEEE Inc. New York, vol. 37, No. 2, Feb. 1, 1989, pp. 324-334.
Search Report dated Apr. 29, 2004.

* cited by examiner

*Primary Examiner*—Benny Lee
(74) *Attorney, Agent, or Firm*—Joseph J. Laks; Robert D. Shedd; Brian J. Cromarty

(57) ABSTRACT

The invention relates to RF bandpass filters with pseudo-elliptic response. In a filter comprising a dielectric substrate placed in E position in a rectangular waveguide and comprising inserts on one of the surfaces of the substrate are placed conductors linked electrically to the walls of the guide, and on the other surface of the substrate opposite these conducting inserts are placed electrically floating inserts that make it possible to determine zeros in the transmission curve of the filter. This yields a filter exhibiting a response curve of pseudo-elliptic type which improves the rejection of spurious frequencies without increasing the dimensions of the filter.

3 Claims, 2 Drawing Sheets

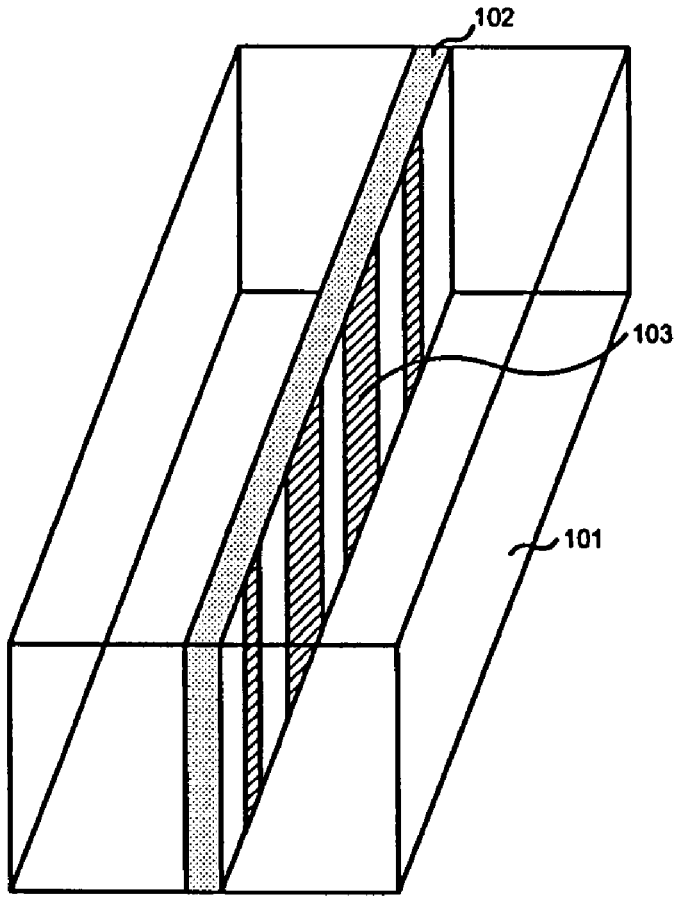
Prior Art Fig. 1
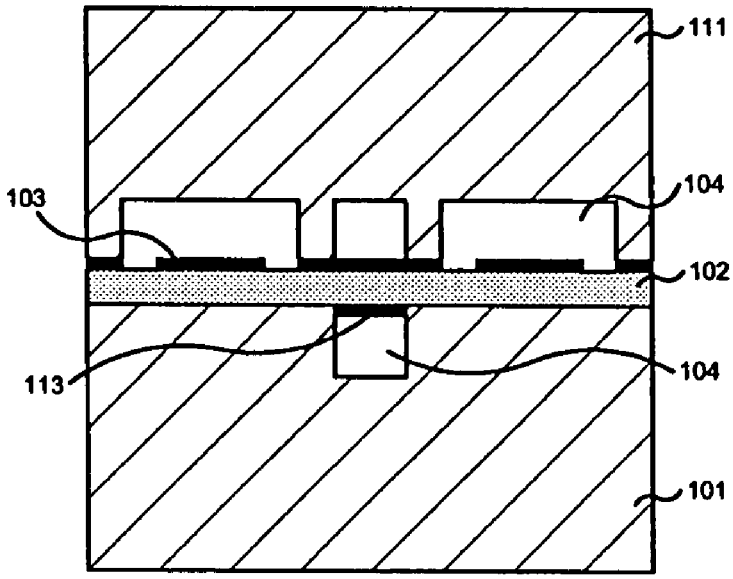
Prior Art Fig. 2

WAVEGUIDE E-PLANE RF BANDPASS FILTER WITH PSEUDO-ELLIPTIC RESPONSE

This application claims the benefit, under 35 U.S.C. § 365 of International Application PCT/EP03/51049, filed Dec. 18, 2003, which was published in accordance with PCT Article 21(2) on Jul. 22, 2004 in English and which claims the benefit of French patent application No. 0300160, filed Jan. 6, 2003.

BACKGROUND OF THE INVENTION

The present invention pertains to RF bandpass filters with pseudo-elliptic response, more particularly to those embodied in E-plane guide technology with a printed dielectric insert. It applies more particularly to wireless telecommunication systems operating in the millimeter region and having to meet high spectral purity demands.

DESCRIPTION OF THE PRIOR ART

Within the framework of broadband bidirectional communications using a geostationary satellite in the Ka band, there is a need to use, in terminals intended for the mass market, an output filter making it possible to attenuate the spurious signals situated outside the useful band, typically 29.5-30 GHz. This filter must make it possible more particularly to reject the local oscillator frequency, typically situated at 28.5 GHz. To comply with the constraints of the mass market, this filter must be low cost.

Given the required demands, it is known to use for this purpose a technology of waveguide type according to various schemes, in particular:

- filters with mono or multi-mode cavities coupled together by inductive or capacitive irises;
- evanescent mode filters;
- filters of the E-plane type, comprising metal inserts or printed dielectric inserts, commonly referred to as FINLINE.

The basic technology used in the present invention corresponds to the last cited above and is illustrated in FIG. 1.

In FIG. 1, an RF waveguide 101 of rectangular cross section is divided into two identical parts by a plane dielectric substrate 102 situated in the E-plane of propagation of this guide. This substrate has low losses and minimum thickness (less than 0.2 mm for example) so as not to degrade the quality factor of the waveguide. However, in this figure, as well as in the others, the thickness of the substrate has been represented greatly enlarged to facilitate readability.

On at least one of its faces the substrate 102 comprises printed conductors 103 linked electrically to the internal faces of the waveguide which support the substrate 102 and whose topology determines the desired response of the filter. To simplify the language, these conductors 103, linked electrically to the waveguide, will be referred to as conducting inserts.

The main benefit of this technology is the ability to integrate and to interface easily with other planar technologies, such as microstrip or suspended microstrip technology. This then makes it possible to integrate the filtering function into the printed circuits on the main card of the emission system.

An example of such integration is represented as a cross section in FIG. 2.

A dielectric substrate 102 is enclosed between a bedplate 101 and a cover 111. This bedplate and this cover are hollowed out with channels 104 which determine two modes of transmission: a guided mode and a line transmission mode. Conductors 103 printed on the upper surface of the substrate 102, and conductor 113 on the lower surface, make it possible to modify the response curve of these waveguides. The technologies illustrated in this figure correspond in respect of the upper face of the substrate to the microstrip technology, and in respect of the lower face to the FINLINE technology.

The bandpass filter topology most commonly used in the technologies represented in FIGS. 1 and 2 consists in using n+1 grounded inductive inserts linked electrically to the internal faces of the guide, when n is the order of the filter. These inserts are spaced apart by approximately half a guided wavelength, and are in principle printed on just one face of the substrate. However, to minimize the sensitivity of the response of the filter to manufacturing tolerances, the inserts are often preferably printed in a substantially identical manner on both faces of the substrate, but they are still connected to the internal walls of the guide.

The response curve of the bandpass filters obtained in this way is of the so-called Chebyshev type.

To obtain the necessary spectral selectivity, it is theoretically possible to use a high order filter. The filter then obtained exhibits considerable physical dimensions and strong sensitivity to manufacturing errors pertaining to its dimensions. It is therefore in practice very difficult, or even impossible, to manufacture.

It is however known in the art for transmission zeros situated at the frequencies or in the frequency bands to be rejected to be introduced into the synthesis of a filter of the Chebyshev type so as to obtain optimal selectivity together with a better fit to the template to be complied with, while reducing the order of the filter, and hence its bulkiness, to the minimum. The response thus obtained is dubbed "pseudo-elliptic type".

However, to date no method is known whereby such transmission zeros can be introduced into a Chebyshev type filter made in a waveguide according to the method described hereinabove.

SUMMARY OF THE INVENTION

To solve this problem, the invention proposes a RF bandpass filter with pseudo-elliptic response, of the type comprising a waveguide furnished with an insulating substrate placed in an E-plane of the waveguide and comprising on one of its faces inductive conducting inserts connected electrically to the internal faces of the guide which support the substrate and which through their dimensions and their locations on the substrate determine a Chebyshev type filter response curve. The filter furthermore comprises at least one electrically floating insert placed on the other face of the substrate and which through its dimensions and its location on the substrate determines a transmission zero in the response curve of the filter making it possible to attenuate the frequencies situated in the vicinity of this zero and determining the pseudo-elliptic nature of the response curve of the filter.

The expression "floating insert" should be understood to mean a conducting insert that is not electrically linked to an electrical potential, so that its voltage is imposed on it by the electromagnetic field crossing the filter.

The expression "transmission zero" should be understood to mean total attenuation in the response curve of the filter, the attenuation being achieved for a given frequency.

According to various characteristics, the filter comprises a set of floating inserts determining a set of transmission zeros. The number of floating inserts is equal to the number of conducting inserts. Each floating insert is placed opposite a conducting insert. The waveguide is of rectangular cross section and the substrate is placed in a median longitudinal position in this guide. Each inductive insert is connected electrically to two opposite sides of the waveguide. The filter is adapted to operate in a millimeter wave range.

BRIEF DESCRIPTION OF THE DRAWINGS

Other features and advantages of the invention will become clearly apparent in the following description, presented by way of non limiting example in conjunction with the appended figures which represent:

FIG. 1, a view of a prior art bandpass filter of the Chebyshev type in E-plane guide technology with dielectric insert;

FIG. 2, a cross-sectional view of a prior art structure combining the microstrip, FINLINE, and E-plane guide technologies;

DESCRIPTION OF THE PREFERRED EMBODIMENTS

Figure 3:
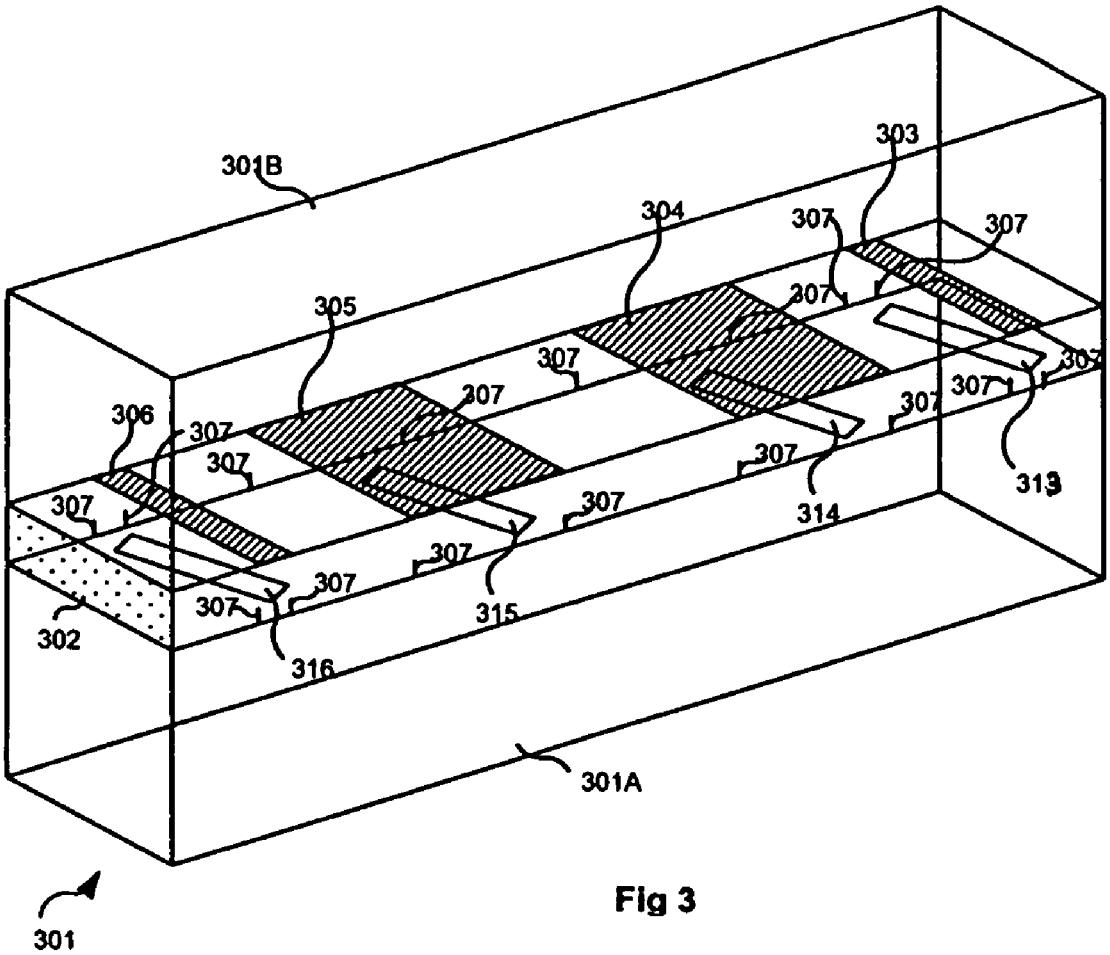
FIG. 3, a view under the conditions of FIG. 1 of a bandpass filter according to the invention.

Referring to FIG. 3, the filter according to the invention, as illustrated in this figure, is of comparable structure to that of FIG. 1 and comprises a waveguide 301 furnished with a thin dielectric substrate 302 placed longitudinally in the E-plane of this waveguide. The upper face of this substrate comprises four inductive inserts 303, 304, 305, 306 formed of wider or narrower rectangular metallizations whose ends situated on the longitudinal edges of the substrate are in electrical contact with the internal lateral faces 301A and 301B of the guide which support the substrate. Preferably, these inductive inserts are connected electrically to two opposite sides of the waveguide so as to ensure the best possible electrical contact. These inserts make it possible to obtain the Chebyshev type bandpass filtering function.

The dimensions and the location of the inserts are determined in a known manner so as to obtain the desired response curve. In this specific case, since there are four inserts the filter is of order 3.

According to the invention, the lower face of the substrate comprises two inserts 314 and 315 here formed of narrow rectangular metallizations and which reduce to two conducting bands. These metallizations are electrically "floating", that is to say they are not linked to the two lateral faces 301A and 301B of the guide which carries the substrate. They are placed facing the inserts 304 and 305 situated on the other face of the substrate and are more or less inclined with respect to the longitudinal axis of the waveguide.

To facilitate the understanding of the figure, the lower face of the substrate has been marked with small dashes 307 forming the four corners of structures in which a "floating" insert 314 or 315 can take place. This combined structure makes it possible to generate transmission zeros in the response curve of the filter without entailing any increase in the overall size thereof. The frequencies at which these zeros are situated are determined by the dimensions and the orientations of these "floating" inserts in the determined structure. These dimensions and these orientations are also determined by a method of synthesis known per se. The complete set of dimensioning parameters, both those of the inductive conducting inserts and those of the "floating" inserts, allow global tailoring of the response curve of the filter as a function of the desired response.

In the example described, the addition of two inserts 314 and 315 make it possible to introduce two zeros into the response curve, but it would have been possible to add just one or to add four of them by placing two other floating inserts 313 and 316 opposite the corresponding conducting inserts 303 and 306.

In a general manner, it is possible to generate up to n+1 transmission zeros in a filter of order n since the filter comprises n+1 conducting inserts. The designer of the filter will therefore be able to distribute these zeros on either side of the passband of the filter so as to best comply with the template imposed. It will be appreciated that the closer the zeros are placed to the passband, the more the filter's template will be disrupted. In most cases it will therefore be necessary to re-engineer the conducting inserts so as to regain satisfactory performance in terms of matching and bandwidth. This will be done by well known methods of iteration that will be all the easier to implement as the numerous zeros that may thus be introduced with great flexibility make it possible to alter a much greater number of parameters than in the case of the filter of the entirely Chebyshev type. It will even be possible to profit from this flexibility so as to decrease the order of the filter and hence its bulkiness and its cost while retaining very considerable selectivity.

The filter represented in FIG. 3 corresponds to a particular embodiment which has been implanted in a standard guide of type WR28 of cross section $3.556 \times 7.112$ mm$^2$, furnished with a substrate of type RO4003 and of thickness 0.2 mm.

Figure 4:
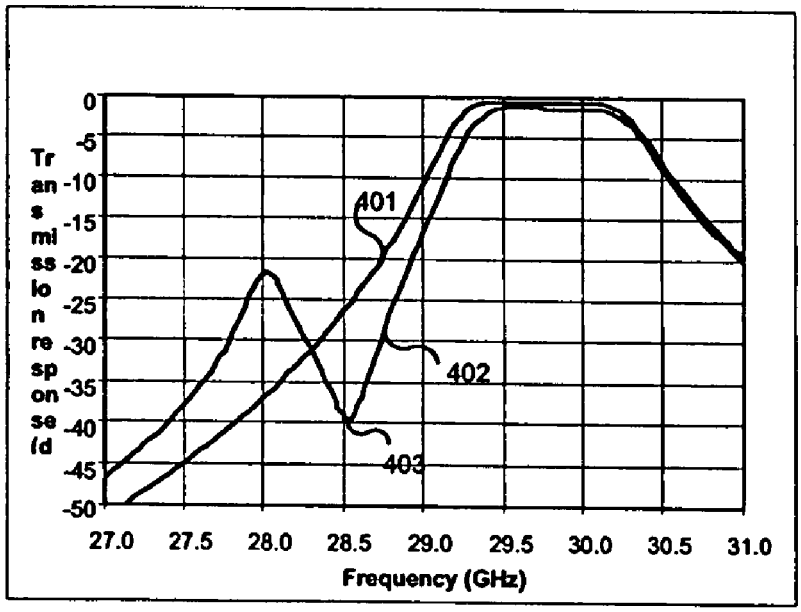
FIG. 4, a comparative graph of the response curves of a filter of the purely Chebyshev type and of a filter according to the invention.

This filter is of order 3, hence with four conducting inserts, and these inserts have been engineered to obtain a passband in accordance with that of a terminal of Ka type, i.e. 29.5-30.0 GHz. The response curve of this filter when it comprises these conducting inserts only, is therefore solely of the Chebyshev type, and is represented at 401 in FIG. 4.

The dimensions of the "floating" inserts have been determined so as to obtain two zeros very close to the frequency of 28.5 GHz to be rejected. They correspond to the troughs 403 of the curve 402 of FIG. 4. This curve 402 is that of the pseudo-elliptic response of the exemplary embodiment described hereinabove of a filter according to the invention.

It is noted that in this example the two zeros are very dose, thereby preventing them from being distinguished in the response curve, and that an attenuation of greater than 13 dB of the spurious frequency to be eliminated is obtained as compared with the filter of purely Chebyshev type.

The upturn around 28.0 GHz is not problematic and may possibly be eliminated by other means, for example by introducing other additional zeros. Furthermore the steepness of the cut-off edge of the filter at low frequencies is improved. These advantages are obtained while preserving the initial dimensions of the filter and at extremely low cost, since it consists merely in arranging a few additional metallizations on an already existing substrate.

A few variants may readily be undertaken regarding the shape and the position of the floating inserts without jeopardizing the invention. The dimension of the floating inserts depends on their resonant frequency. It is possible that they may exhibit a dimension such that it is not possible to include their entire surface under an inductive insert. It is also possible to resort to elbowed inserts.

The invention claimed is:

1. A RF waveguide bandpass filter with pseudo-elliptic response, including an insulating substrate placed in an E-plane of the waveguide the substrate, comprising an upper surface of the substrate inductive inserts connected electrically to the internal faces of the waveguide which support the substrate such as to form a Chebyshev type filter, and, on a lower surface of the substrate, at least one electrically floating insert placed facing one of the inductive inserts on the upper surface, having a dimension and being inclined in relation to the longitudinal axis of the waveguide, such as to obtain at least a transmission zero occurring at a desired frequency to be rejected.

2. The filter according to claim 1, wherein the filter comprises two floating inserts determining two transmission zeros occurring at two desired frequencies.

3. The filter according to claim 1, wherein a number of said at least one electrically floating insert is equal to a number of inductive inserts.

* * * * *